United States Patent [19]

Courtis et al.

[11] 4,381,626

[45] May 3, 1983

[54] AUTOMATIC GATE ASSEMBLY

[75] Inventors: Thomas M. Courtis; Carl E. Donelson, both of Red Lodge, Mont.

[73] Assignee: Red Lodge Manufacturing Co., Red Lodge, Mont.

[21] Appl. No.: 237,713

[22] Filed: Feb. 24, 1981

Related U.S. Application Data

[63] Continuation-in-part of Ser. No. 82,543, Oct. 9, 1979, Pat. No. 4,270,312.

[51] Int. Cl.[3] ..... E05D 7/00

[52] U.S. Cl. ..... 49/385; 49/386; 49/139

[58] Field of Search ..... 49/385, 331, 332, 139, 49/289, 327

[56] References Cited

U.S. PATENT DOCUMENTS

| | | | |
|---|---|---|---|
| 1,062,928 | 5/1913 | Roof | 49/385 |
| 1,386,113 | 8/1921 | Houck | 49/327 |
| 3,839,826 | 10/1974 | Reis | 49/385 X |
| 4,270,312 | 6/1981 | Courtis et al. | 49/139 X |
| 4,313,281 | 2/1982 | Richmond | 49/139 X |

*Primary Examiner*—Kenneth Downey

*Attorney, Agent, or Firm*—Arthur L. Urban

[57] ABSTRACT

A gate assembly including a support structure, a gate carried by the support structure and movable with respect thereto, a gate control and a gate activator associated with the gate, the support structure including a plurality of frame members, the gate having one end thereof disposed adjacent to the support structure and extending outwardly therefrom, a pivot connecting a lower part of the gate to an adjacent lower portion of the support structure, the pivot including a rotatable shaft and shaft carrier, the gate control including a biasing mechanism associated with the gate, the gate activator including a power source mounted on the support structure, drive mechanism operatively connected to the power source, the drive mechanism including translating mechanism activatable by the power source, the translating mechanism being disposed for movement in a substantially horizontal plane, an arm member having one end pivotally connected to the translating mechanism, the arm member having its opposite end pivotally connected to the gate, the connection between the arm member and the gate being at a point on the gate adjacent the support structure and centrally located between the upper and lower edges of the gate, whereby the gate is movable about the pivot in a vertical plane by the gate activator.

12 Claims, 2 Drawing Figures

AUTOMATIC GATE ASSEMBLY

Figure 1:
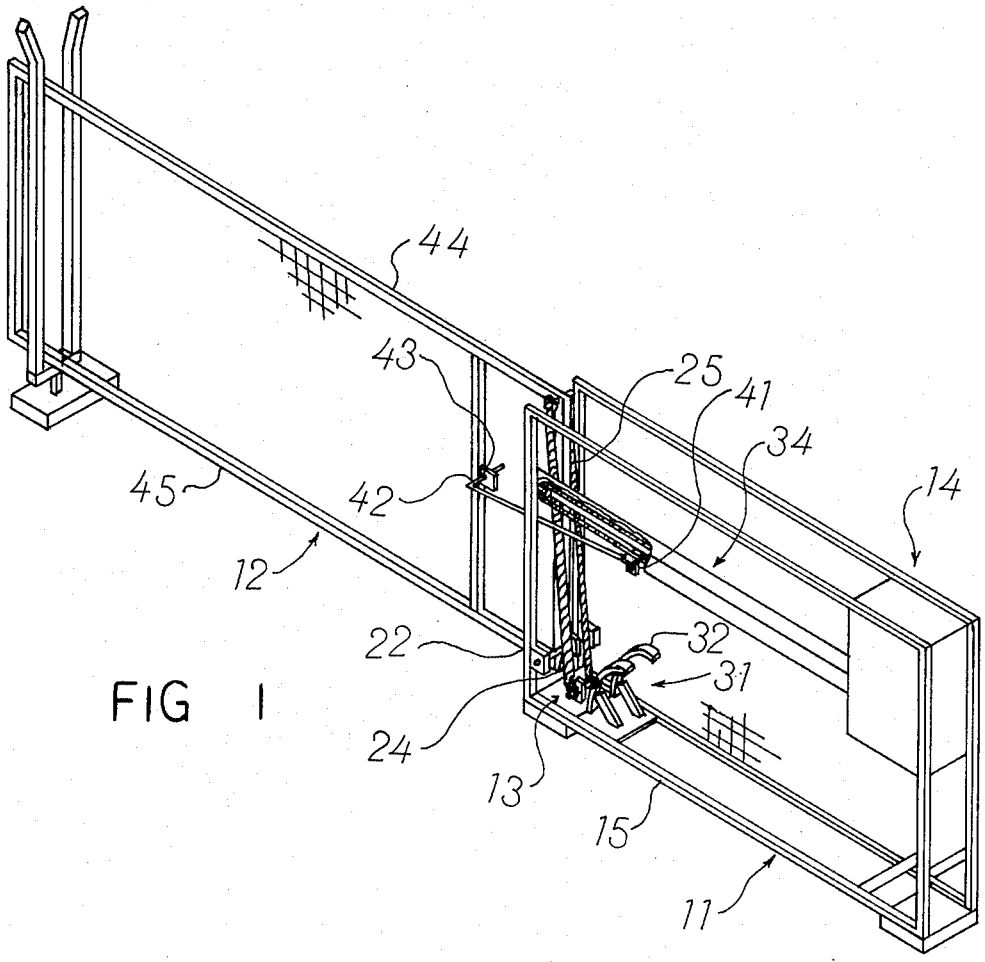

This application is a continuation-in-part of pending application Ser. No. 82,543, filed Oct. 9, 1979, now U.S. Pat. No. 4,270,312.

This invention relates to a novel gate assembly and more particularly relates to a new gate assembly which can be operated automatically.

For many centuries, individuals have enclosed their land to protect their home and other property. This has been done both in urban and rural areas. In some cases, the enclosures have been simple fences to keep children or animals confined, while in other situations, the fencing serves to protect the property against human or animal intruders.

Regardless of the type of enclosure or fencing utilized, some type of opening must be provided for ingress and egress to and from the property. Generally, the opening has a gate. Gates commonly are used for walkways and roadways. The most common gate style is the swinging gate. While swinging gates are satisfactory for walkways, their use becomes more cumbersome as they increase in size, such as for roadways.

Conventional roadway gates have a number of drawbacks. For example, the weight of roadway gates presents a problem in the selection of the hinges. Also, the weight may make the gate difficult to operate. In an attempt to solve these problems, pairs of gates meeting at the center sometimes are utilized.

Another problem with roadway gates is the necessity for getting out of the vehicle to open the gate, driving the vehicle through and getting out of the vehicle again to close the gate. This is troublesome even under ideal weather conditions, but in inclement weather and at night it is especially unpleasant.

It has been proposed to utilize power operated roadway gates. However, mechanisms to operate swinging gates are complicated and expensive. As a result, other proposals for power operated roadway gates have been made. Some gates have an overhead framework into which the gates are raised. Such gates of necessity have limited overhead clearance and are unsightly in appearance because of the overhead structural elements.

One power operated gate of a different design pivots the gate so that it stands on end when opened. This type of gate is the subject of U.S. Pat. No. 3,839,826. The gate utilizes a combination of a tension spring and a torsion spring. The tension spring urges the gate from the closed position toward the open position while the torsion spring acts in the opposite direction.

While this vertically swinging gate construction offers advantages over swinging gates, particularly in snowy climates, it has certain shortcomings. The motor has to be of considerable size because of its location adjacent the pivot point of the gate. Also, the use of the combination of the torsion spring and the tension spring makes the design somewhat complicated and increases the cost thereof.

The present invention provides a novel gate assembly that can be operated simply and conveniently with a conventional power source. The gate assembly can be powered by a conventional garage door opening unit. The gate assembly can be operated manually if desired using only a minimum of effort. Thus, the gate assembly of the invention can be opened easily in the event of a power stoppage.

The gate assembly of the invention is simple in design and relatively inexpensive to manufacture. The gate assembly can be fabricated from commercially available components and materials. The design of the gate assembly minimizes the possibility of vandalism, particularly to the operating mechanism. Further, the design provides a maximum opening for a given overall length. The gate assembly of the invention provides an aesthetically pleasing low silhouette.

The gate assembly can be installed by a homeowner or ranch hand with a minimum of instruction. The gate assembly of the invention can be adapted to provide a positive lock if desired. In addition, the gate assembly of the invention provides for adjustment of the operating mechanism as components thereof age and/or wear.

Figure 2:
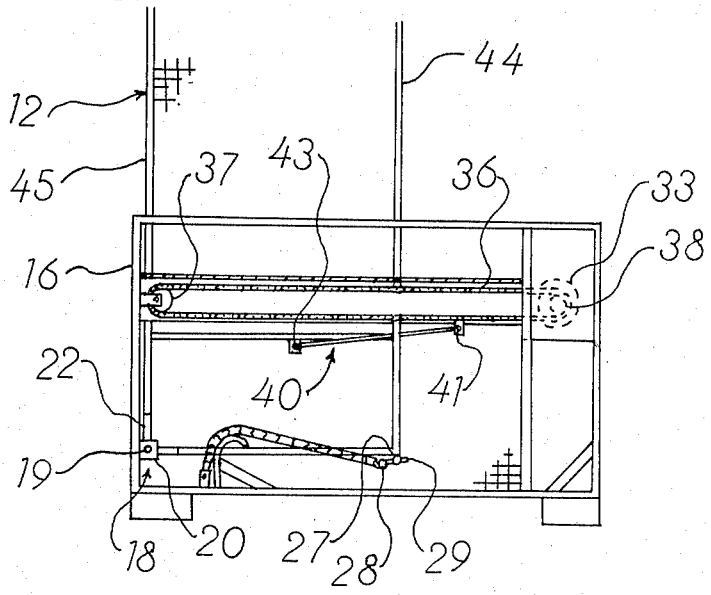

Other benefits and advantages of the novel gate assembly of the present invention will be apparent from the following description and the accompanying drawings in which:

FIG. 1 is a view in perspective of one form of the gate assembly of the invention in a closed position; and FIG. 2 is an enlarged fragmentary side view of the gate assembly shown in FIG. 1 in an open position.

As shown in the drawings, one form of the novel gate assembly of the invention includes support means 11 and gate means 12 carried by the support means. The gate portion 12 is movable with respect to the support means 11. Also, gate control means 13 and gate activating means 14 are included in the gate assembly. The gate control means 13 and the gate activating means 14 preferably are mounted on frame members of the support portion 11 shown as generally horizontal members 15 and generally vertical members 16. Advantageously, the support 11 includes pairs of generally vertical and horizontal frame members 15 and 16 disposed on either side of the gate.

Gate 12 which is movable with respect to the support 11 has one end thereof disposed adjacent thereto with the gate 12 extending outwardly therefrom. The lower part of the gate end adjacent to the support frame is connected thereto through pivot means 18.

The pivot means 18 connecting the gate 12 with the support frame 11 includes a rotatable shaft 19 and shaft support means. Shaft 19 is carried by shaft supporting brackets 20 affixed to vertical frame members 16. Pivot means 18 advantageously may include a gate support member 22 that can be affixed or carried by the central portion of shaft 19. Preferably, the gate support member 22 includes a gate engaging channel section which is secured to the end of the gate 12 adjacent support frame 11. In this case, the shaft 19 may be located on the side of frame member 16 adjacent to the spring members.

The gate control means 13 includes biasing means and advantageously at least one coil spring member 24. Preferably, the biasing means includes a pair of coil spring members 24 and 25. The spring members 24 and 25 are spaced from each other a sufficient distance that the gate 12 may pass therebetween in its movement from a closed to an open position. The upper end of each spring member is attached adjacent the upper corner of the gate closest thereto, that is, closest to the vertical frame members 16. The opposite or lower end of each spring member is affixed to a horizontal frame member 15 of support 11 at a point therealong spaced from the pivot means 18. Advantageously, the lower ends of the spring members are secured to the horizontal frame member 15 a distance from the shaft 19 of the pivot means 18 between about 25% and 40% of the length of the spring member.

The gate assembly advantageously also includes spring adjusting means. Preferably, the spring adjusting means changes the length and thereby the tension in the spring members 24 and 25. The upper ends of the spring members 24 and 25 advantageously are connected to the adjacent upper corner of the gate 12 through the spring adjusting means, which preferably may include a fixed portion 27 and a movable portion 28. As shown in FIG. 2, section 27 is affixed adjacent the corner of the gate 12 and movable section 28 engages the upper ends of the spring members 24 and 25. A screw 29 is operatively connected to the movable spring holding section 28 to provide adjustment thereof.

Fulcrum means 31, advantageously also a part of the gate control means 13, is disposed adjacent the lower end of the spring members 24 and 25. The fulcrum means 31 is affixed to the horizontal frame member 15 on the side of the spring members remote from the pivot means 18. The fulcrum 31 includes an arcuate spring-engaging section 32 disposed in substantially the same vertical plane as the coil spring members. Advantageously, the spring-engaging section 32 of the fulcrum describes an arc of between about 120° and 180°. The spring-engaging section 32 preferably is spaced from the lower ends of the spring members a distance between about 10% and 30% of the length of the spring members. The fulcrum 31 may serve for both of the spring members 24 and 25 or more advantageously as shown, a separate fulcrum may be utilized adjacent each spring member. With this arrangement, the spacing of the fulcrums provides clearance for the passage of the gate 12 therebetween.

The gate assembly of the invention includes gate activating means 14 to provide movement of the gate 12 from the down or closed position to the open or raised position and return. The gate activating means 14 advantageously is mounted on the support means 11 and preferably within the framework thereof. Gate activating means 14 includes a power source which advantageously includes an electric motor 33 and also includes drive means 34 operatively connected to the power source.

Drive means 34 includes translating means which advantageously is shown as flexible connecting means 36. The flexible connecting means 36 preferably is a chain, cable or the like. The flexible connecting means may form a continuous loop which extends between a roller or sprocket 37 and an output drive 38 of motor 33. The flexible connecting means 36 is disposed for movement in a substantially horizontal plane.

An arm member 40 connects gate 12 with the translating means 36. Arm member 40 has one end 41 pivotally connected to the translating means 36. The opposite end 42 of arm member 40 is pivotally connected to gate 12. The connection between the arm member 40 and the gate 12 is at a point 43 on the gate adjacent the support means 11. Advantageously, the connections between the arm member 40 and the gate 12 and/or the translating means 36 are releasable connections such as a threaded bolt and nut as shown, a quick release arrangement of the type commonly employed with garage door operators or the like.

The connecting point 43 between the arm member 40 and the gate 12 is centrally located between the upper and lower edges 44 and 45 respectively of the gate 12. Preferably, the pivotal connection is disposed at a point from the horizontal center line of the gate within about 10% of the height thereof. Such an arrangement permits the stroke of the arm member 40 to be relatively short. A short stroke of the arm member 40 facilitates minimizing the length of the support means 11. Since the length of the support structure 11 is in addition to the gate length, a shorter support allows a larger gate opening for a given overall length.

In the operation and use of the gate assembly of the present invention as shown in the drawings, the gate activating mechanism 14 may be actuated such as with a radio transmitter and receiver (not shown) of a garage door operator. This starts the operation of the electric motor 33 and the rotation of sprocket 38 and flexible connector 36 carried thereby. The movement of the flexible connector 36 moves arm member 40 and draws the upper corner of the gate 12 into the support frame 11 and rotates the end of the gate about the pivot means including shaft 19. As the upper corner of the gate continues in its path of movement within the support frame 11, the upper corner and the end of the spring members 24 and 25 affixed thereto will move past the fulcrums 31 causing the spring members to wrap around the spring-engaging sections 32 of the fulcrums. The upward movement of the gate 12 will continue until the gate has rotated to a position at approximately a right angle to the original horizontal position.

To close the gate assembly, the radio transmitter may be actuated again to reverse the movement of the motor and the direction of travel of the flexible connector 36 and arm member 40. This action will move the top corner of the gate 12 from a position adjacent the horizontal members 15 past the fulcrums 31 again to its original position at the upper part of the vertical frame members 16. Simultaneously, with the travel of the gate 12, the upper part of the spring members attached at the upper corner of the gate will move away from the spring-engaging fulcrum sections 32 so that the spring members will return from the bent configuration when the gate is open to the straight configuration again.

Operation of the gate assembly of the invention also can be effected through the use of electrical switches (not shown) located adjacent the assembly rather than with a radio transmitter. In addition, if there should be a power failure, the gate assembly can be operated manually. Manual operation may be achieved conveniently by disconnecting arm member 40 from the gate and/or flexible connector 36 and simply lifting the free end of the gate 12.

Since the spring members 24 and 25 in combination with the fulcrums 31 provide an effective counterbalancing of the movement of the gate, the gate can be lifted manually with a minimum of effort. Also, since the spring members 24 and 25 function effectively over the entire path of movement of the gate from an open to a closed position and vice-versa, positive control of the gate movement is achieved during the entire operation.

The above description and accompanying drawings show that the present invention provides a novel gate assembly that can be operated with a power source and even by a conventional garage door opening unit. The gate assembly can be operated manually in the event of a power failure with a minimum of effort. The gate assembly can be operated through a radio transmitter or suitable switches.

The gate assembly of the invention is simple in design yet minimizes the possibility of vandalism. In addition, the design provides a low silhouette appearance with a maximum opening for a given overall length.

The gate assembly of the invention can be fabricated from commercially available components and materials relatively inexpensively. The gate assembly of the invention can utilize commercially available gates or custom fabricated gates.

The gate assembly of the present invention can be installed by a homeowner or a ranch hand with a minimum of instruction. In addition, the gate assembly provides for the adjustment of the control mechanism as components thereof age and/or wear.

It will be apparent that various modifications can be made in the particular gate assembly described in detail above and shown in the drawings within the scope of the invention. For example, the size, configuration and arrangement of the components can be changed to meet specific requirements. Also, a variety of structural materials may be utilized in the fabrication of the gate assembly as desired. Therefore, the scope of the invention is to be limited only by the following claims.

What is claimed is:

1. A gate assembly including support means, gate means carried by said support means and movable with respect thereto, gate control means and gate activating means associated with said gate means, said support means including a plurality of frame members, said gate means having one end thereof disposed adjacent to said support means and extending outwardly therefrom, pivot means connecting a lower part of said gate means to an adjacent lower portion of said support means, said pivot means including a rotatable shaft and shaft carrier means, said gate control means including biasing means associated with said gate means, said gate activating means including a power source mounted on said support means, drive means operatively connected to said power source, said drive means including translating means activatable by said power source, said translating means being disposed for movement in a substantially horizontal plane, an arm member having one end pivotally connected to said translating means, said arm member having its opposite end pivotally connected to said gate means, said connection between said arm member and said gate means being at a point on said gate means adjacent said support means and centrally located between said upper and lower edges of said gate means, whereby said gate means is movable about said pivot means in a vertical plane by said gate activating means.

2. A gate assembly according to claim 1 wherein said power source and said translating means are disposed within the frame members of said support means.

3. A gate assembly according to claim 1 wherein said support means has a horizontal dimension only slightly larger than the vertical dimension of said gate means.

4. A gate assembly according to claim 1 wherein said arm member is pivotally connected to said gate means at a point from the horizontal center line of said gate means within about 10% of the height of said gate means.

5. A gate assembly according to claim 1 wherein said translating means includes flexible connecting means.

6. A gate assembly according to claim 5 wherein said flexible connecting means includes a continuous loop.

7. A gate assembly according to claim 5 wherein said flexible connecting means includes a chain.

8. A gate assembly according to claim 5 wherein said translating means includes a cable.

9. A gate assembly according to claim 1 wherein said pivotal connection between said arm member and said translating means is a releasable connection.

10. A gate assembly according to claim 1 wherein said power source includes an electric motor.

11. A gate assembly according to claim 1 wherein said biasing means includes at least one coil spring member extending between an upper part of said gate means adjacent to said support means and said support means at a point spaced from said pivot means.

12. A gate assembly according to claim 11 including fulcrum means disposed adjacent the end of the said spring member affixed to said support means.

* * * * *